US007198360B2

(12) United States Patent
Watanabe et al.

(10) Patent No.: US 7,198,360 B2
(45) Date of Patent: Apr. 3, 2007

(54) LAMINATED BONDING STRUCTURE OF THIN PLATE MEMBERS AND INKJET PRINTING HEAD

(75) Inventors: Hidetoshi Watanabe, Aichi (JP); Tadanobu Chikamoto, Aichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 144 days.

(21) Appl. No.: 10/879,024

(22) Filed: Jun. 30, 2004

(65) Prior Publication Data

US 2005/0024445 A1 Feb. 3, 2005

(30) Foreign Application Priority Data

Jun. 30, 2003 (JP) ..... P2003-186727

(51) Int. Cl.
*B41J 2/045* (2006.01)

(52) U.S. Cl. ..... 347/71; 347/68

(58) Field of Classification Search ..... 347/68–72; 29/25.35

See application file for complete search history.

(56) References Cited

U.S. PATENT DOCUMENTS 5,779,837 A 7/1998 Harvey ..... 456/153
6,290,340 B1 * 9/2001 Kitahara et al. ..... 347/70
6,361,155 B1 3/2002 Kanda et al. ..... 347/70
6,536,879 B2 3/2003 Ito et al. ..... 347/71
2002/0036678 A1 3/2002 Ito et al. ..... 347/71
2003/0048328 A1 * 3/2003 Inamoto et al. ..... 347/44

FOREIGN PATENT DOCUMENTS

| | | |
|---|---|---|
| EP | 1 293 343 A2 | 3/2003 |
| JP | A 57-093163 | 6/1982 |
| JP | A 10-157150 | 6/1998 |
| JP | A 2002-96477 | 4/2002 |
| JP | A-2002-096478 | 4/2002 |
| JP | A-2002-240272 | 8/2002 |

* cited by examiner

*Primary Examiner*—Manish S. Shah
*Assistant Examiner*—Lisa M. Solomon
(74) *Attorney, Agent, or Firm*—Oliff & Berridge, PLC

(57) ABSTRACT

A laminated bonding structure of thin plate members includes; a plurality of thin plate members laminated through an adhesive agent, the plurality of thin plate members including at least one thin plate member having a plurality of holes formed therein; and a hole group encircling groove that encircles a hole group constituted by at least part of the plurality of holes is formed on the thin plate member having the plurality of holes.

18 Claims, 10 Drawing Sheets

LAMINATED BONDING STRUCTURE OF THIN PLATE MEMBERS AND INKJET PRINTING HEAD

BACKGROUND OF THE INVENTION

1. Field of the Invention

The present invention relates to a laminated bonding structure of thin plate members in which a plurality of thin plate members, which is used in such as an inkjet printing head and an electronic component, are laminated and bonded so as to be fixed, and an inkjet printing head using the laminated thin plate members.

2. Description of the Related Art

A laminated bonding structure in an inkjet printing head has been disclosed in JP-2002-096477 (see pages 4 and 5, FIGS. 1 through 3 and FIG. 7). In the structure, a plurality of nozzles, a cavity plate having pressure chambers formed in accordance with the plurality of nozzles and ink flow paths for circulating ink into the pressure chambers, and a piezoelectric actuator for giving pressure to ink in the pressure chambers in accordance with the pressure chambers are laminated through an adhesive agent. The cavity plate in the inkjet printing head is composed of a plurality of plates. The pressure chambers are formed in a base plate as the uppermost layer of the cavity plate on which the piezoelectric actuator is laminated. Throttles (apertures) connected to the pressure chambers respectively and being smaller in sectional shape than the pressure chambers are formed in the base plate so that oversupply of ink into the pressure chambers can be prevented when the piezoelectric actuator is driven continuously. Escape grooves smaller in sectional area than the throttles are formed in positions near to the throttles.

When the piezoelectric actuator is bonded to the base plate through the adhesive agent to laminate such a plurality of plates to produce an inkjet printing head, the adhesive agent passing through a narrow gap such as a mating surface between the base plate and the piezoelectric actuator is first attracted by a small sectional area portion larger in capillary force than a large sectional area portion. As a result, a surplus of the adhesive agent is first led into the escape grooves, so that the throttles can be prevented from being blocked with the adhesive agent.

SUMMARY OF THE INVENTION

In the technique described in JP-2002-096477, there is however a problem that choking of each ink flow path occurs because the adhesive agent flows from the outside of the ink flow path into the pressure chamber or throttle in accordance with irregularity or variation in application of the adhesive agent spread to the base plate as the size of the inkjet printing head increases.

Therefore, one of objects of the invention is to provide a laminated bonding structure of thin plate members in which choking of each flow path caused by inflow of an adhesive agent hardly occurs, and an inkjet printing head using the laminated bonding structure.

According to a first aspect of the invention, there is provided a laminated bonding structure of thin plate members including: a plurality of thin plate members laminated through an adhesive agent, the plurality of thin plate members including at least one thin plate member having a plurality of holes formed therein; and a hole group encircling groove that encircles a hole group constituted by at least part of the plurality of holes is formed on the thin plate member having the plurality of holes.

According to a second aspect of the invention, there is provided a laminated bonding structure of thin plate members including: a plurality of thin plate members laminated through an adhesive agent, the plurality of thin plate members including at least one thin plate member having a plurality of holes formed therein; and a partition groove formed on the thin plate member having the plurality of holes, the partition groove formed on outside of a hole group constituted by at least part of the plurality of holes, and divides a surface of the thin plate member into a plurality of partitions.

According to a third aspect of the invention, there is provided an inkjet printing head including: a flow path unit including pressure chambers arranged along a plane and connected to nozzles respectively; and an actuator unit being fixed to a surface of the flow path unit and changes volume of each of the pressure chambers, wherein the flow path unit includes: a plurality of thin plate members laminated through an adhesive agent, the plurality of thin plate members including at least one thin plate member having a plurality of holes formed therein; and a hole group encircling groove that encircles a hole group constituted by at least part of the plurality of holes is formed on the thin plate member having the plurality of holes.

BRIEF DESCRIPTION OF THE DRAWINGS

These and other objects and advantages of the present invention will become more fully apparent from the following detailed description taken with the accompanying drawings, in which.

DETAILED DESCRIPTION OF THE PREFERRED EMBODIMENTS

Referring now to the accompanying drawings, a description will be given in detail of a preferred embodiment of the invention.

Figure 1:
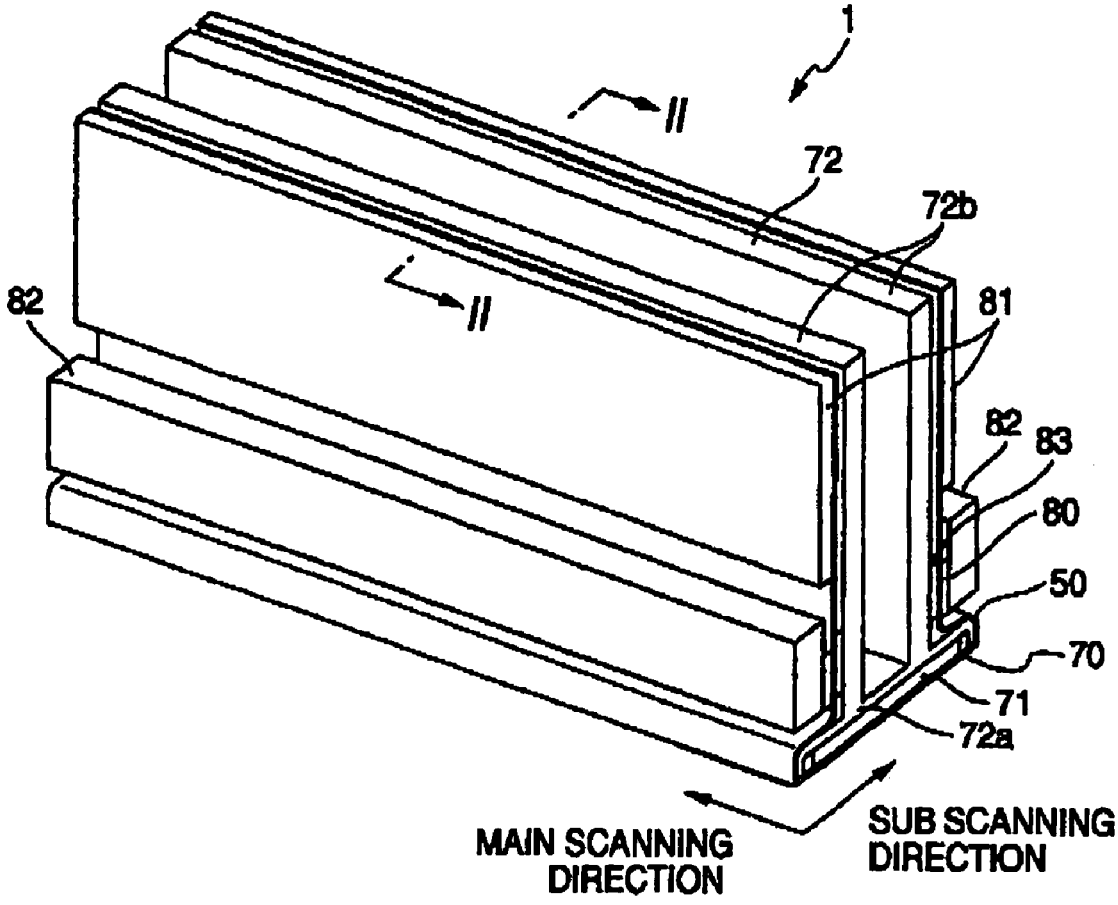
FIG. 1 is a perspective view showing the external appearance of an inkjet printing head according to the invention.
Figure 2:
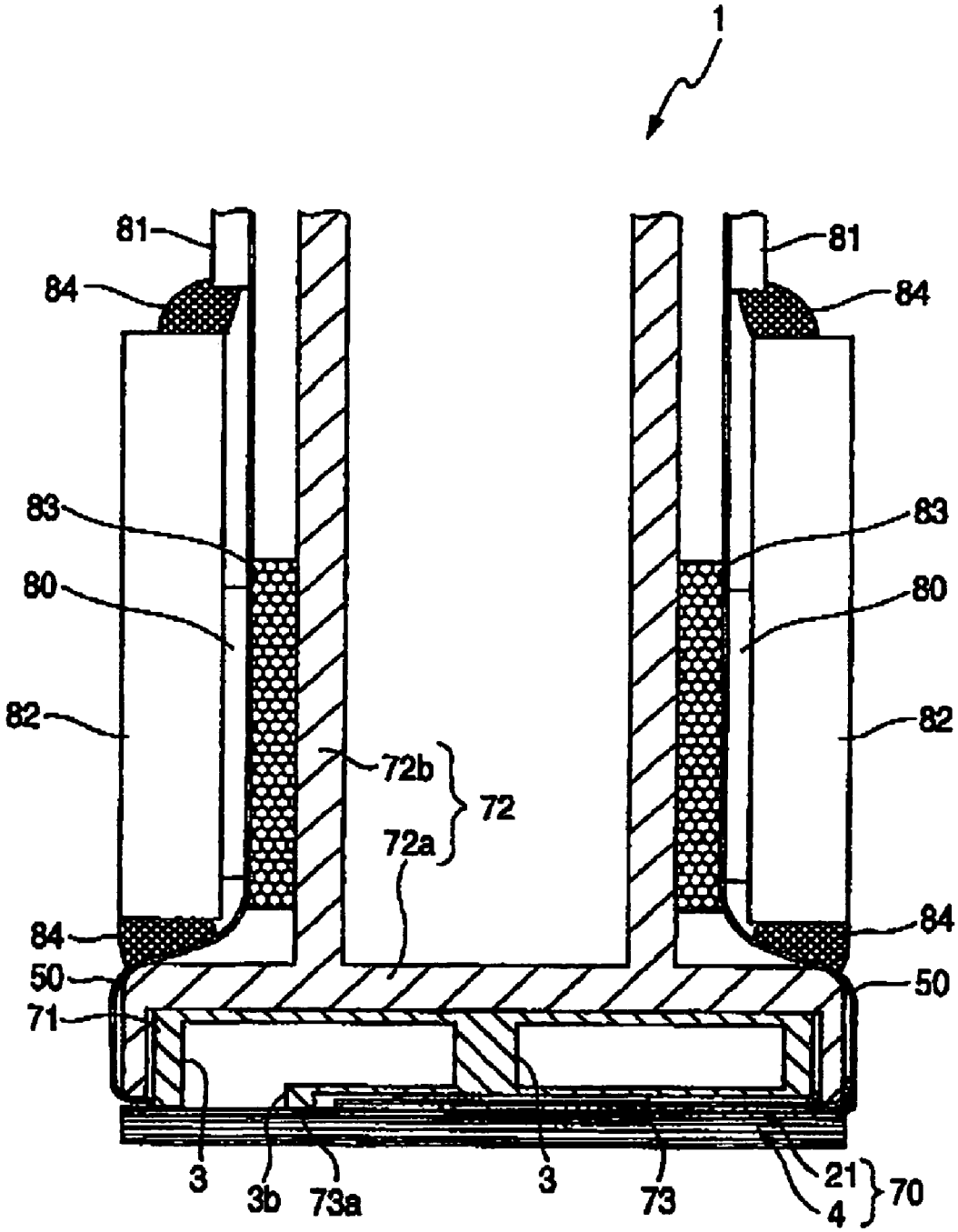
FIG. 2 is a sectional view taken along the line II—II in FIG. 1.

FIG. 1 is a perspective view showing the external appearance of an inkjet printing head according to the invention. FIG. 2 is a sectional view taken along the line II—II in FIG. 1. The inkjet printing head 1 has a head body 70, and a base block 71. The head body 70 is shaped like a flat rectangle extending in a main scanning direction for ejecting ink onto a sheet of paper. The base block 71 is disposed above the head body 70 and includes ink reservoirs 3 formed as flow paths of ink supplied to the head body 70.

The head body 70 includes a flow path unit 4, and a plurality of actuator units 21. An ink flow path is formed in the flow path unit 4. The plurality of actuator units 21 are bonded onto an upper surface of the flow path unit 4. The flow path unit 4 and actuator units 21 are formed in such a manner that a plurality of thin plate members are laminated and bonded to one another. Flexible printed circuit boards (hereinafter referred to as FPCs) 50 which are feeder circuit members are bonded onto an upper surface of the actuator units 21. The FPCs 50 are led upward while bent as shown in FIG. 2. The base block 71 is made of a metal material such as stainless steel. Each of the ink reservoirs 3 in the base block 71 is a nearly rectangular parallelepiped hollow region formed along a direction of the length of the base block 71.

A lower surface 73 of the base block 71 protrudes downward from its surroundings in neighbors of openings 3*b*. The base block 71 touches the flow path unit 4 only at neighbors 73*a* of the openings 3*b* of the lower surface 73. For this reason, all other regions than the neighbors 73*a* of the openings 3*b* of the lower surface 73 of the base block 71 are isolated from the head body 70 so that the actuator units 21 are disposed in the isolated portions.

The base block 71 is bonded and fixed into a cavity formed in a lower surface of a grip 72*a* of a holder 72. The holder 72 includes a grip 72*a*, and a pair of flat plate-like protrusions 72*b* extending from an upper surface of the grip 72*a* in a direction perpendicular to the upper surface of the grip 72*a* so as to form a predetermined distance between each other. The FPCs 50 bonded to the actuator units 21 are disposed so as to go along surfaces of the protrusions 72*b* of the holder 72 through elastic members 83 such as sponge respectively. Driver ICs 80 are disposed on the FPCs 50 disposed on the surfaces of the protrusions 72*b* of the holder 72. The FPCs 50 are electrically connected to the driver ICs 80 and the actuator units 21 (will be described later in detail) by soldering so that drive signals output from the driver ICs 80 are transmitted to the actuator units 21 of the head body 70.

Nearly rectangular parallelepiped heat sinks 82 are disposed closely on outer surfaces of the driver ICs 80, so that heat generated in the driver ICs 80 can be radiated efficiently. Boards 81 are disposed above the driver ICs 80 and the heat sinks 82 and outside the FPCs 50. Seal members 84 are disposed between an upper surface of each heat sink 82 and a corresponding board 81 and between a lower surface of each heat sink 82 and a corresponding FPC 50 respectively. That is, the heat sinks 82, the boards 81 and the FPCs 50 are bonded to one another by the seal members 84.

Figure 3:
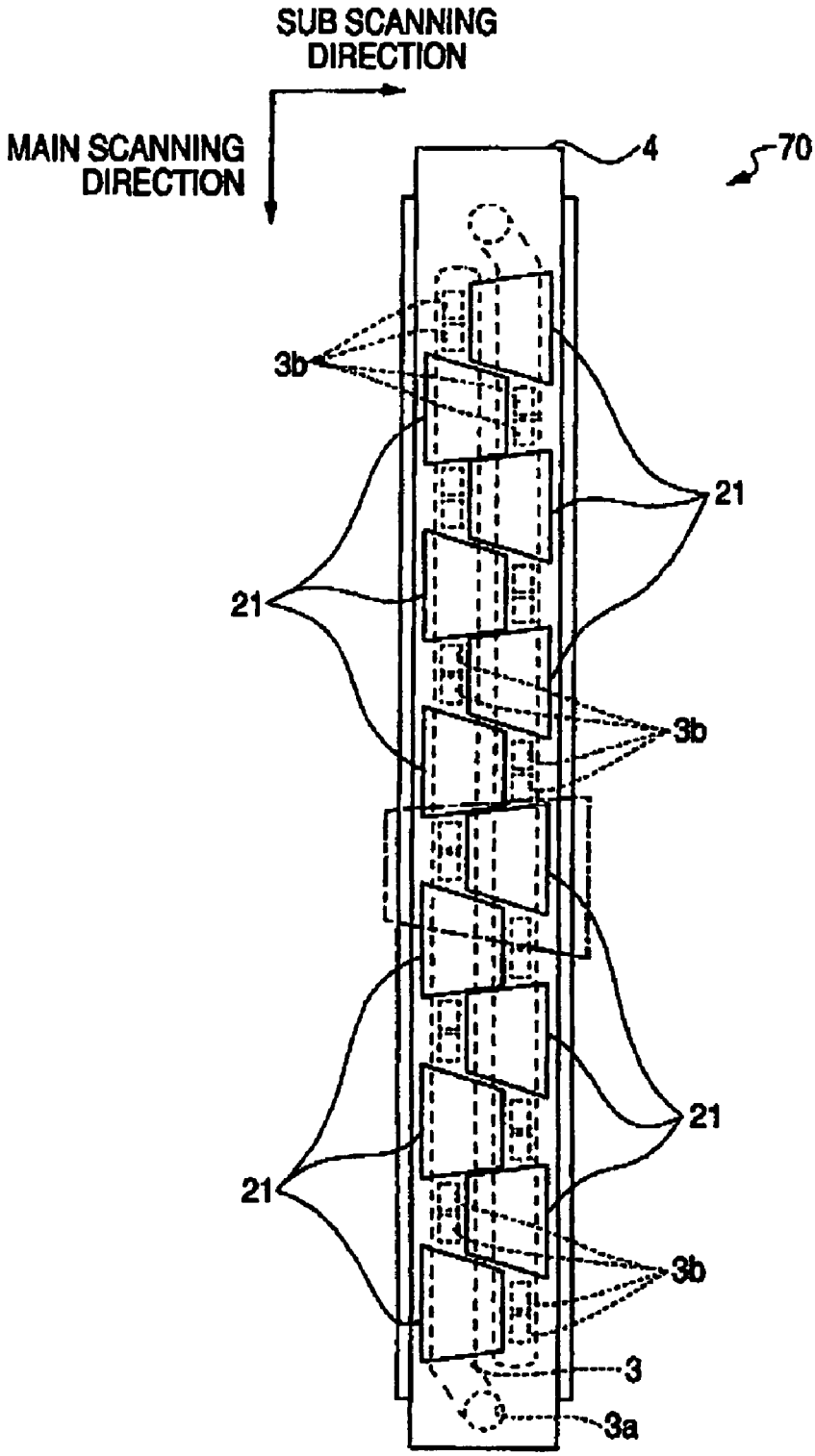
FIG. 3 is a plan view of a head body included in the inkjet printing head depicted in FIG. 2.

FIG. 3 is a plan view of the head body included in the inkjet printing head depicted in FIG. 2. In FIG. 3, the ink reservoirs 3 formed in the base block 71 are drawn virtually by the broken line. Two ink reservoirs 3 extend in parallel to each other along a direction of the length of the head body 70 so as to form a predetermined distance between the two ink reservoirs 3. Each of the two ink reservoirs 3 has an opening 3*a* at its one end. The two ink reservoirs 3 communicate with an ink tank (not shown) through the openings 3*a* so as to be always filled with ink. A large number of openings 3*b* are provided in each ink reservoir 3 along the direction of the length of the head body 70. As described above, the ink reservoirs 3 are connected to the flow path unit 4 by the openings 3*b*. The large number of openings 3*b* are formed in such a manner that each pair of openings 3*b* are disposed closely along the direction of the length of the head body 70. The pairs of openings 3*b* connected to one ink reservoir 3 and the pairs of openings 3*b* connected to the other ink reservoir 3 are arranged in staggered layout.

The plurality of actuator units 21 each having a trapezoid flat shape are disposed in regions where the openings 3*b* are not provided. The plurality of actuator units 21 are arranged in staggered layout so as to have a pattern reverse to that of the pairs of openings 3*b*. Parallel opposed sides (upper and lower sides) of each actuator unit 21 are parallel to the direction of the length of the head body 70. Inclined sides of adjacent actuator units 21 partially overlap each other in a direction of the width of the head body 70.

Figure 4:
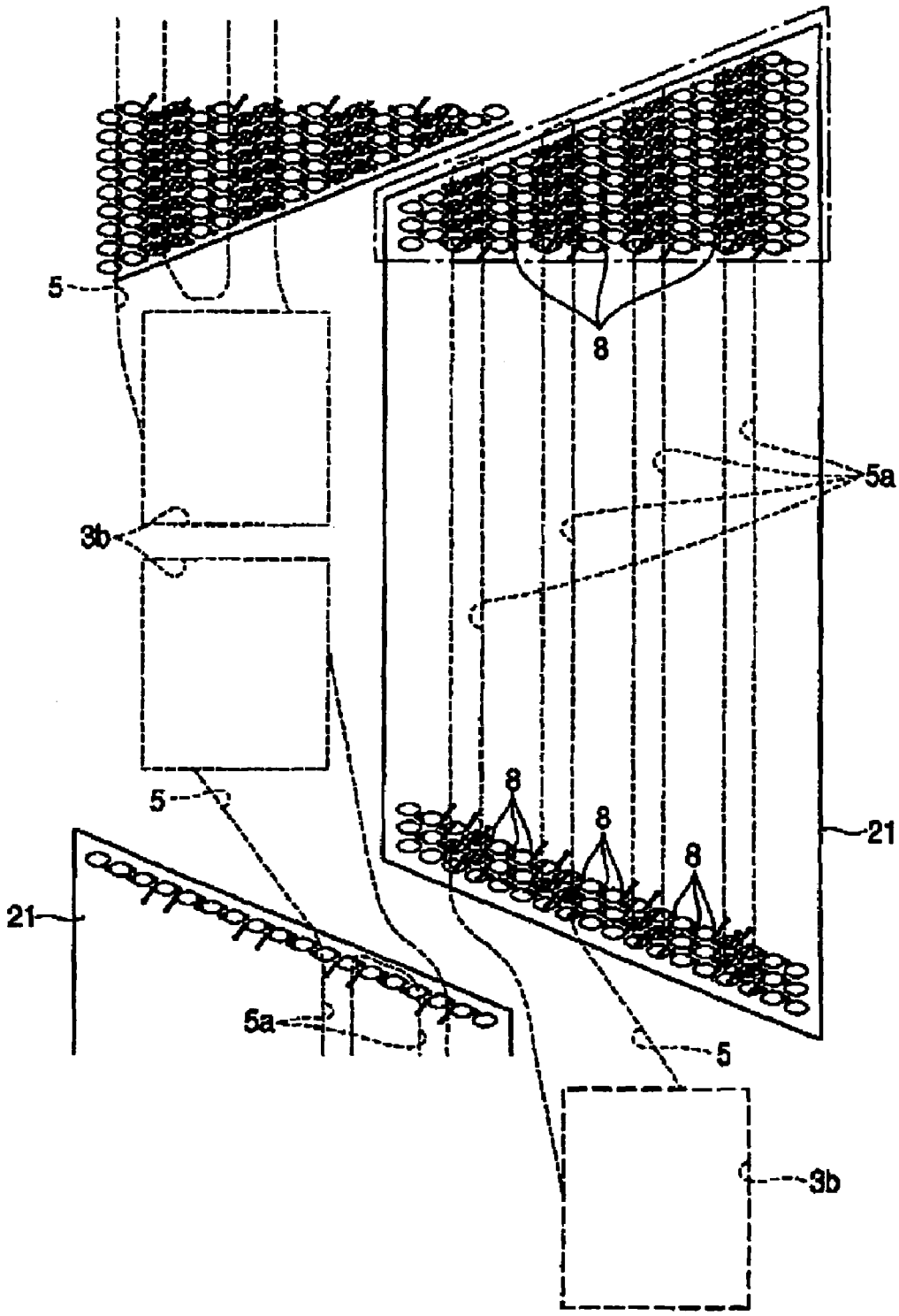
FIG. 4 is an enlarged view of a region surrounded by the chain line in FIG. 3.

FIG. 4 is an enlarged view of a region surrounded by the chain line in FIG. 3. As shown in FIG. 4, the openings 3*b* provided in each ink reservoir 3 communicate with manifolds 5 which are common ink chambers respectively. An end portion of each manifold 5 branches into two sub manifolds 5*a*. In plan view, every two sub manifolds 5*a* separated from adjacent openings 3*b* extend from two inclined sides of each actuator unit 21. That is, four sub manifolds 5*a* in total are provided below each actuator unit 21 and extend along the parallel opposed sides of the actuator unit 21 so as to be separated from one another.

Ink ejection regions are formed in a lower surface of the flow path unit 4 corresponding to the bonding regions of the actuator units 21. As will be described later, a large number of nozzles 8 are disposed in the form of a matrix in a surface of each ink ejection region. Although FIG. 4 shows several nozzles 8 for the sake of simplification, nozzles 8 are actually arranged on the whole of the ink ejection region.

Figure 5:
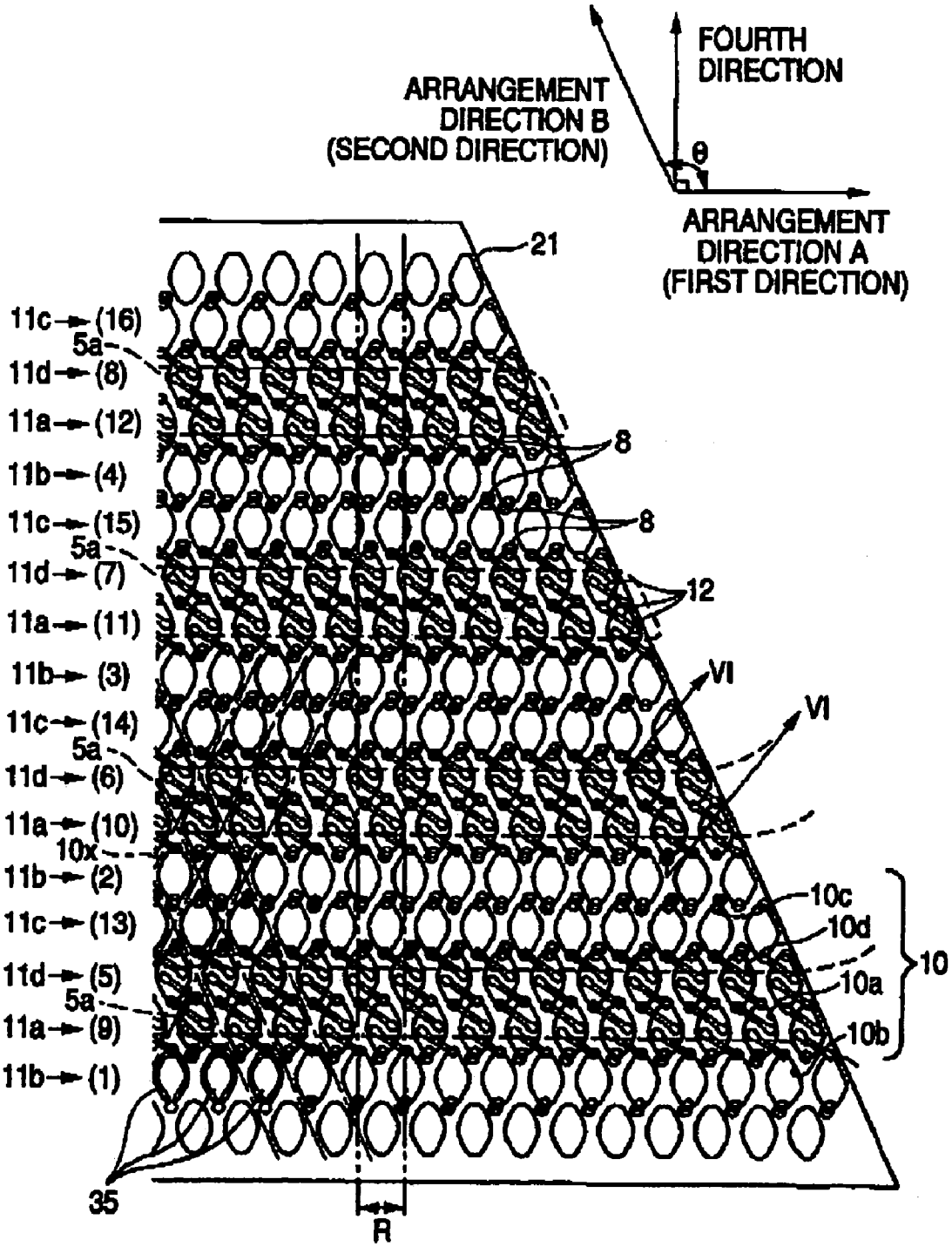
FIG. 5 is an enlarged view of a region surrounded by the chain line in FIG. 4.

FIG. 5 is an enlarged view of a region surrounded by the chain line in FIG. 4. FIGS. 4 and 5 show a state in which a plane of a large number of pressure chambers 10 disposed in the form of a matrix in the flow path unit 4 is viewed from a direction perpendicular to the ink ejection surface. Each of the pressure chambers 10 is shaped substantially like a rhomboid having rounded corners in plan view. The long diagonal line of the rhomboid is parallel to the direction of the width of the flow path unit 4. Each pressure chamber 10 has one end connected to a corresponding nozzle 8, and the other end connected to a corresponding sub manifold 5*a* as a common ink flow path through an aperture 12. An individual electrode 35 having a planar shape similar to but size smaller than that of each pressure chamber 10 is formed on the actuator unit 21 so as to be adjacent to the pressure chamber 10 in plan view. Some of a large number of individual electrodes 35 are shown in FIG. 5 for the sake of simplification. Incidentally, the pressure chambers 10 and apertures 12 that must be expressed by the broken line in the actuator units 21 or in the flow path unit 4 are expressed by the solid line in FIGS. 4 and 5 to make it easy to understand the drawings.

In FIG. 5, a plurality of virtual rhombic regions 10*x* in which the pressure chambers 10 are stored respectively are disposed adjacently in the form of a matrix both in an arrangement direction A (first direction) and in an arrangement direction B (second direction) so that adjacent virtual rhombic regions 10*x* have common sides not overlapping each other. The arrangement direction A is a direction of the length of the inkjet printing head 1, that is, a direction of extension of each sub manifold 5*a*. The arrangement direction A is parallel to the short diagonal line of each rhombic region 10*x*. The arrangement direction B is a direction of one inclined side of each rhombic region 10*x* in which an obtuse angle θ is formed between the arrangement direction B and the arrangement direction A. The central position of each pressure chamber 10 is common to that of a corresponding rhombic region 10*x* but the contour line of each pressure chamber 10 is separated from that of a corresponding rhombic region 10*x* in plan view.

The pressure chambers 10 disposed adjacently in the form of a matrix in the two arrangement directions A and B are formed at intervals of a distance corresponding to 37.5 dpi along the arrangement direction A. The pressure chambers 10 are formed so that sixteen pressure chambers 10 are arranged in the arrangement direction B in one ink ejection region. Pressure chambers located at opposite ends in the arrangement direction B are dummy chambers that do not contribute to ink ejection.

The plurality of pressure chambers 10 disposed in the form of a matrix form a plurality of pressure chamber columns along the arrangement direction A shown in FIG. 5. The pressure chamber columns are separated into first pressure chamber columns 11*a*, second pressure chamber columns 11*b*, third pressure chamber columns 11*c* and fourth pressure chamber columns 11*d* in accordance with positions relative to the sub manifolds 5*a* viewed from a direction (third direction) perpendicular to the paper surface of FIG. 5. The first to fourth pressure chamber columns 11*a* to 11*d* are arranged cyclically in order of 11*c*->11*d*->11*a*->11*b*->11*c*->11*d*-> . . . ->11*b* from an upper side to a lower side of each actuator unit 21.

In pressure chambers 10*a* forming the first pressure chamber column 11*a* and pressure chambers 10*b* forming the second pressure chamber column 11*b*, nozzles 8 are unevenly distributed on a lower side of the paper surface of FIG. 5 in a direction (fourth direction) perpendicular to the arrangement direction A when viewed from the third direction. The nozzles 8 are located in lower end portions of corresponding rhombic regions 10*x* respectively. On the other hand, in pressure chambers 10*c* forming the third pressure chamber column 11*c* and pressure chambers 10*d* forming the fourth pressure chamber column 11*d*, nozzles 8 are unevenly distributed on an upper side of the paper surface of FIG. 5 in the fourth direction. The nozzles 8 are located in upper end portions of corresponding rhombic regions 10*x* respectively. In the first and fourth pressure chamber columns 11*a* and 11*d*, regions not smaller than half of the pressure chambers 10*a* and 10*d* overlap the sub manifolds 5*a* when viewed from the third direction. In the second and third pressure chamber columns 11*b* and 11*c*, the regions of the pressure chambers 10*b* and 10*c* do not overlap the sub manifolds 5*a* at all when viewed from the third direction. For this reason, pressure chambers 10 belonging to any pressure chamber column can be formed so that the sub manifolds 5*a* are widened as sufficiently as possible while nozzles 8 connected to the pressure chambers 10 do not overlap the sub manifold 5*a*. Accordingly, ink can be supplied to the respective pressure chambers 10 smoothly.

Figure 6:
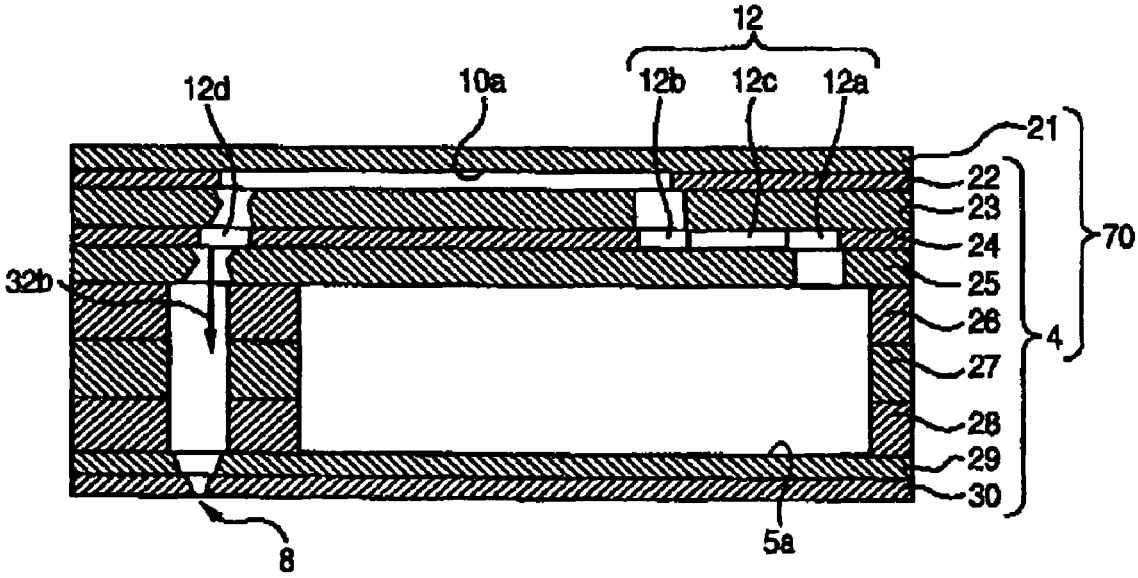
FIG. 6 is a sectional view taken along the line VI—VI in FIG. 5.

Next, the sectional structure of the head body 70 will be further described with reference to FIGS. 6 and 7. FIG. 6 is a sectional view taken along the line VI—VI in FIG. 5. One of pressure chambers 10*a* belonging to the first pressure chamber column 11*a* is shown in FIG. 6. As is obvious from FIG. 6, each nozzle 8 communicates with a sub manifold 5*a* through a pressure chamber 10 (10*a*) and an aperture 12. In this manner, individual ink flow paths 32 are formed in the head body 70 in accordance with the pressure chambers 10 so that each individual ink flow path 32 extends from an outlet of the sub manifold 5*a* to the nozzle 8 through the aperture 12 and the pressure chamber 10.

As is obvious from FIG. 6, the pressure chamber 10 and the aperture 12 are provided so as to be different in level from each other. Accordingly, as shown in FIG. 5, in the flow path unit 4 corresponding to the ink ejection region below the actuator unit 21, the aperture 12 connected to one pressure chamber 10 can be disposed in the same position as that of a pressure chamber 10 adjacent to the pressure chamber in plan view. As a result, the pressure chambers 10 can be disposed so densely as to adhere closely to one another, so that printing of a high-resolution image can be achieved by the inkjet printing head 1 though the inkjet printing head 1 has a relatively small occupied area.

Figure 7:
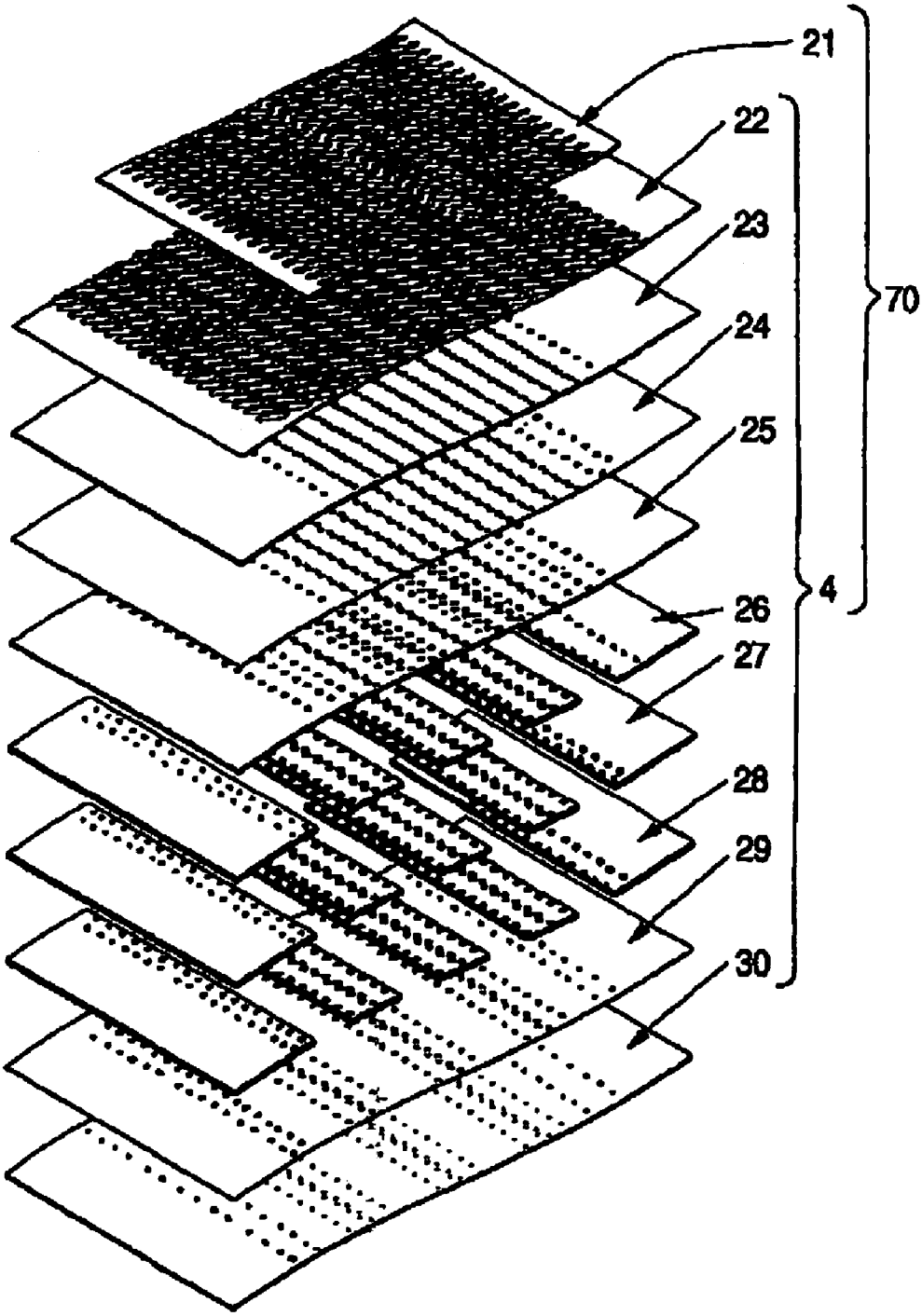
FIG. 7 is a partially exploded perspective view of the head body depicted in FIG. 6.

As is also obvious from FIG. 7, the head body 70 has a laminated structure in which ten sheet members (thin plate members) in total, namely, an actuator unit 21, a cavity plate 22, a base plate 23, an aperture plate 24, a supply plate 25, manifold plates 26, 27 and 28, a cover plate 29 and a nozzle plate 30 are laminated through an adhesive agent in descending order. The ten sheet members except the actuator unit 21, that is, nine sheet plates form the flow path unit 4.

As will be described later in detail, the actuator unit 21 includes a laminate of four piezoelectric sheets 41 to 44 (see FIG. 10A) as four layers, and electrodes disposed so that only the uppermost layer is provided as a layer having a portion serving as an active layer at the time of application of electric field (hereinafter referred to as "active layer-including layer") while the residual three layers are provided as non-active layers. The cavity plate 22 is a metal plate having a large number of approximately rhomboid openings corresponding to the pressure chambers 10. The base plate 23 is a metal plate which has holes each for connecting one pressure chamber 10 of the cavity plate 22 to a corresponding aperture 12, and holes each for connecting the pressure chamber 10 to a corresponding nozzle 8. The aperture plate 24 is a metal plate which has apertures 12 (see FIG. 9), and holes 12*d* each for connecting one pressure chamber 10 of the cavity plate 22 to a corresponding nozzle 8. Each of the apertures 12 has an ink inlet 12*a* on the sub manifold 5*a* side, an ink outlet 12*b* on the pressure chamber 10 side, and a communication portion 12*c* formed slimly while connected to the ink inlet and outlet 12*a* and 12*b*. The supply plate 25 is a metal plate which has holes each for connecting an aperture 12 for one pressure chamber 10 of the cavity plate 22 to a corresponding sub manifold 5*a*, and holes each for connecting the pressure chamber 10 to the nozzle 8. The manifold plates 26, 27 and 28 are metal plates which have the sub manifolds 5*a*, and holes each for connecting one pressure chamber 10 of the cavity plate 22 to a corresponding nozzle 8. The cover plate 29 is a metal plate which has holes each for connecting one pressure chamber 10 of the cavity plate 22 to a corresponding nozzle 8. The nozzle plate 30 is a metal plate which has nozzles 8 each provided for one pressure chamber 10 of the cavity plate 22.

The ten sheets 21 to 30 are laminated while positioned so that individual ink flow paths 32 are formed as shown in FIG. 6. Each individual ink flow path 32 first goes upward from the sub manifold 5*a*, extends horizontally in the aperture 12, goes further upward from the aperture 12, extends horizontally again in the pressure chamber 10, momentarily goes obliquely downward in the direction of departing from the aperture 12 and goes vertically downward to the nozzle 8.

Figure 8:
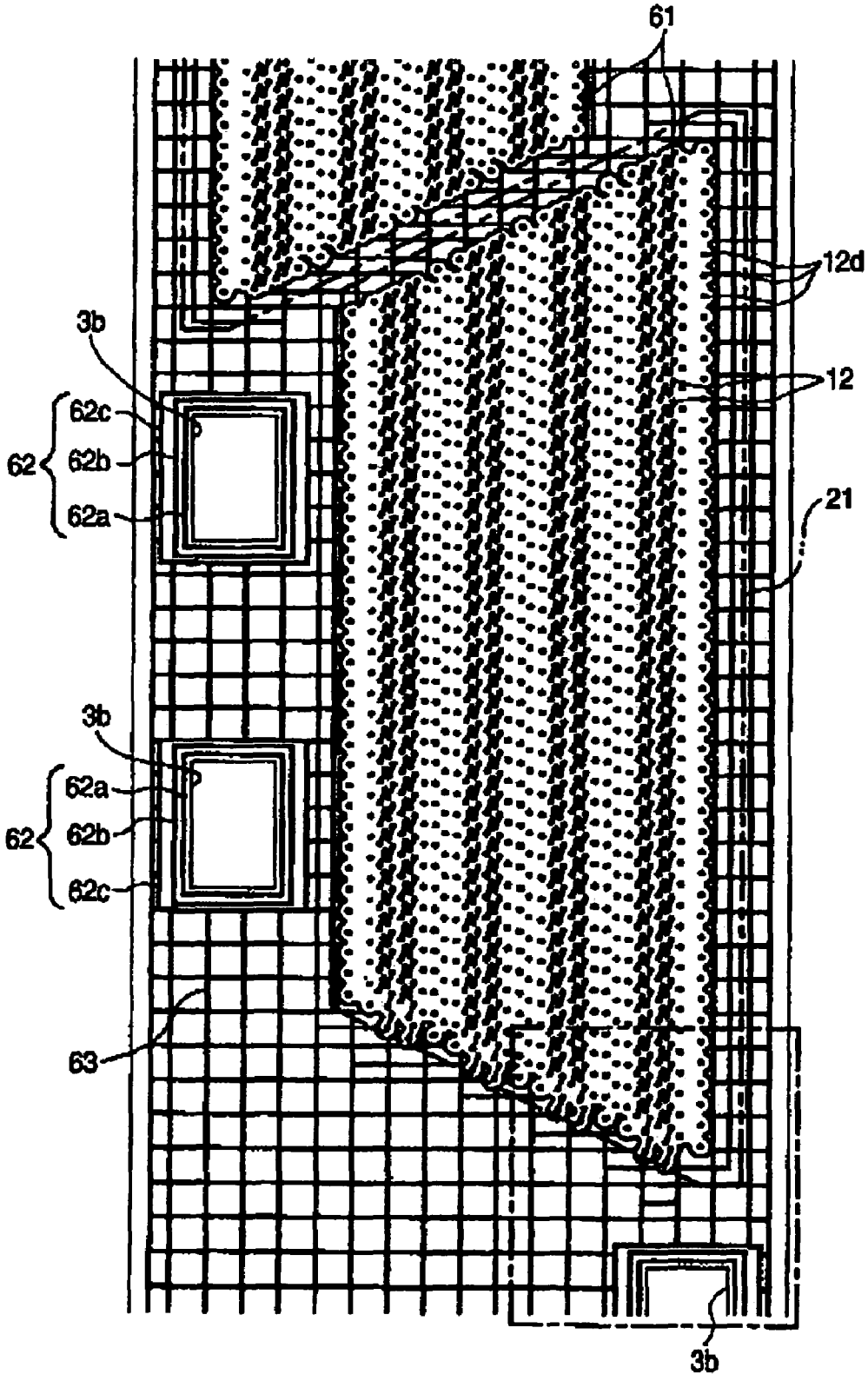
FIG. 8 is a plan view of an aperture plate from the base plate side of the region surrounded by the chain line in FIG. 3.
Figure 9:
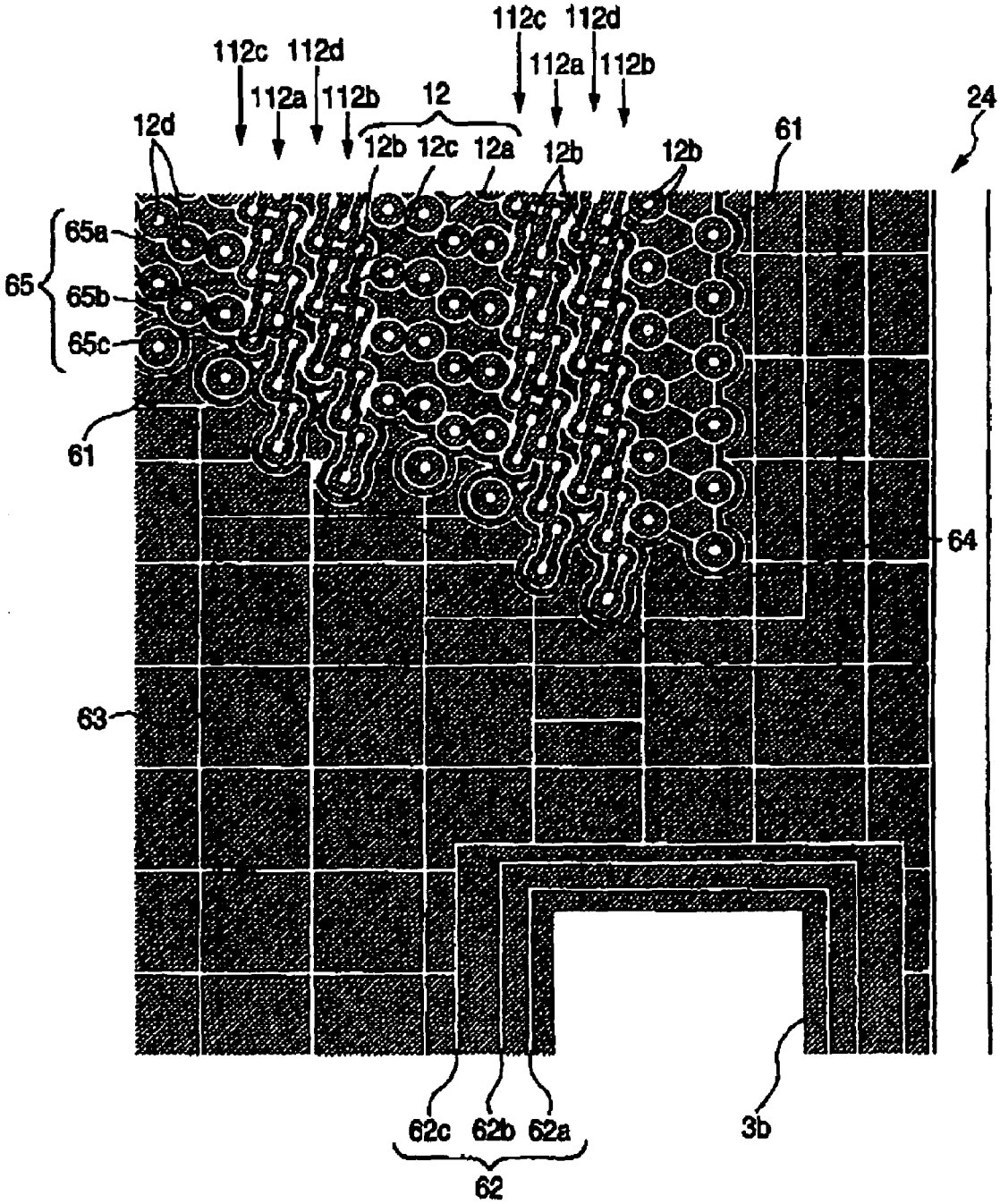
FIG. 9 is an enlarged view of a region surrounded by the chain line in FIG. 8.

FIG. 8 is a plan view of the aperture plate from the base plate side in the region surrounded by the chain line in FIG. 3. FIG. 9 is an enlarged view of a region surrounded by the chain line in FIG. 8. The chain double-dashed line in FIG. 8 is a virtual line expressing the planar shape of the trapezoid of the actuator unit 21 overlapping the aperture plate 24 in the third direction. A plurality of apertures 12 and connection holes 12*d* are formed in the region surrounded by the chain double-dashed line in FIG. 8. The apertures 12 and the connection holes 12*d* partially overlap the pressure chambers 10 so as to be connected to the pressure chambers 10 in the third direction. Accordingly, the apertures 12 and the connection holes 12*d* are arranged adjacently in the form of a matrix in the two arrangement directions A and B in the same manner as the pressure chambers 10. Incidentally, the apertures 12 and the connection holes 12*d* are formed so that sixteen apertures 12 and sixteen connection holes 12*d* are arranged in the arrangement direction B in the same manner as the pressure chambers 10.

As shown in FIG. 9, the apertures 12 are separated into first and fourth aperture columns 112*a* to 112*d* in the same manner as the pressure chambers 10. The first to fourth aperture columns 112*a* to 112*d* correspond to the first to fourth pressure chamber columns 11*a* to 11*d* respectively. When the aperture plate 24 is viewed from the left to the right in FIG. 9, the first to fourth aperture columns 112*a* to 112*d* are arranged cyclically in order of 112*c*->112*a*->112*d*->112*b*->112*c*->112*a*-> . . . ->112*b*. In the first and second aperture columns 112*a* and 112*b*, the ink outlets 12*b* of the apertures 12 are located in the right in FIG. 9. In the third and fourth aperture columns 112*c* and 112*d*, the ink outlets 12*b* of the apertures 12 are located in the left in FIG. 9. Incidentally, the ink inlets 12*a* of the apertures 12 are located in sides opposite to the ink outlets 12*b* of the apertures 12 in the aperture columns 112*a* to 112*d* respectively. The communication portions 12*c* for connecting the ink inlets 12*a* of the apertures 12 to the ink outlets 12*b* of the apertures 12 respectively are formed so that the width of each communication portion 12*c* is smaller than the width of the corresponding ink inlet 12*a* and ink outlet 12*b* in plan view. As a result, flow path resistance of ink between the manifold 5*a* and the pressure chamber 10 can be adjusted.

The apertures 12 and the connection holes 12*d* are formed so as to pass through the aperture plate 24. As shown in FIG. 8, the apertures 12 and connection holes 12*d* form a hole group. As shown in FIG. 8, an encircling groove (hole group encircling groove) 61 is formed in the outermost circumference of the hole group so as to be shaped in accordance with the outer shape of the hole group.

An opening encircling groove 62 is formed in the outer circumference of each of the openings 3*b* of the aperture plate 24 through a bonding tab of a predetermined width so as to be shaped in accordance with the outer shape of each of the openings 3*b*. The opening encircling groove 62 includes an opening encircling groove 62*a* nearest to the opening 3*b*, and opening encircling grooves 62*b* and 62*c* similar in shape to the opening encircling groove 62*a* but enlarged successively. Connection grooves (partition grooves) 63 are formed in a lattice-like arrangement and connected to the encircling grooves 61 and the opening encircling grooves 62*c* are formed in a base plate 23 side planar region of the aperture plate 24 except the inner regions of the encircling grooves 61 and the opening encircling grooves 62.

As shown in FIG. 9, an inner groove 65 is formed inside the encircling groove 61. The inner groove 65 includes a groove 65*a* shaped so as to extend along the outer shape of one connection hole 12*d*, a groove 65*b* shaped so as to extend along the outer shape of two adjacent apertures 12 in the first and third aperture columns 112*a* and 112*c* in the arrangement direction B, and a groove 65*c* shaped so as to extend along the outer shape of two adjacent apertures 12 in the second and fourth aperture columns 112*b* and 112*c* in the arrangement direction B. The grooves 65*a* to 65*c* are connected to one another and also connected to the encircling groove 61 through the connection groove 64. That is, the encircling groove 61, the opening encircling groove 62*c*, the connection grooves 63 and 64 and the inner groove 65 formed on the base plate 23 side of the aperture plate 24 are all connected to one another. Bonding tabs are formed on regions between the inner groove 65 and the aperture 12/connection hole 12*d*, between the inner groove 65 and the encircling groove 61 and between the encircling groove 61 and the connection groove 63, on regions partitioned by the lattice connection groove 63 and on planar regions of the aperture plate 24 between the connection groove 63 and the opening encircling groove 62 and between the opening encircling grooves 62*a* to 62*c* so that the aperture plate 24 and the base plate 23 are bonded to each other by an adhesive agent applied onto the respective regions. The hatched portions in FIG. 9 show the bonding tabs. All the grooves 61, 62, 63, 64 and 65 are formed by means of half-etching on the aperture plate 24 so as to be U-lettered shape.

Incidentally, the communication portions 12*c* for connecting the ink inlets 12*a* of the apertures 12 to the ink outlets 12*b* of the apertures 12 are formed so as to be narrower than the other flow paths, so that choking due to the inflow of the adhesive agent and change in sectional area occur easily to thereby have influence on print quality of the finally produced head sensitively. On the other hand, connection of one connection portion 12*c* to another adjacent connection portion 12*c* caused by reduction in sealability of the flow paths due to shortage of the adhesive agent has influence on print quality. Particularly because each connection portion 12*c* has such an arrangement and structure that the connection portion 12*c* is easily affected by surplus and shortage of the adhesive agent as described above, it is necessary to apply a predetermined amount of the adhesive agent on each bonding tab of a predetermined width. On the contrary, in this embodiment, the encircling groove 61 is formed along the outer shape of the hole group, so that a bonding tab can be secured even on the outer circumference of the hole group to make appropriate bonding possible. Moreover, the adhesive agent is applied onto the regions (bonding tabs) partitioned by the connection groove 63 so that the adhesive agent flowing from the outside of the hole group to the inside of the hole group can be received to a certain degree in the encircling groove 61 when the base plate 23 and the aperture plate 24 are bonded to each other by the adhesive agent. Accordingly, the adhesive agent can be restrained from flowing into the apertures 12 and connection holes 12*d*, so that choking of the individual ink flow paths 32 can be suppressed.

Moreover, the inner grooves 65 are formed in the inside of the encircling groove 61 so as to be disposed along the shapes of the apertures 12 and connection holes 12*d*, so that the inner grooves 65 can restrain the adhesive agent applied on the bonding tab from flowing into the apertures 12 and connection holes 12*d* while the bonding tab can be secured between each inner groove 65 and the aperture 12/connection hole 12*d*. Accordingly, choking of the individual ink flow paths 32 due to the inflow of the adhesive agent can be suppressed more sufficiently.

Moreover, the encircling groove 61 and the inner groove 65 are connected to each other, so that the adhesive agent received by the encircling groove 61 and the inner groove 65 because of the inflow of the adhesive agent can be circulated between the encircling groove 61 and the inner groove 65.

That is, when the amount of the adhesive agent flowing into the encircling groove 61 is small but the amount of the adhesive agent flowing into the inner groove 65 is large, the adhesive agent in the inner groove 65 can be circulated into the encircling groove 61. Accordingly, the amount of the adhesive agent allowed to be received by the inner groove 65 increases. Because the adhesive agent flowing into the apertures 12 and connection holes 12*d* can be received by the inner groove 65 having the allowable amount increased by the encircling groove 61, choking of the individual ink flow paths 32 due to the inflow of the adhesive agent can be suppressed more sufficiently. Incidentally, the grooves 65*a* to 65*c* forming the inner groove 65 are connected to one another, so that the adhesive agent received by the grooves 65*a* to 65*c* can be circulated between the grooves 65*a* to 65*c*. Accordingly, choking of the individual ink flow paths 32 can be suppressed in the same manner as described above.

The regions (bonding tabs) partitioned by the lattice connection groove 63 are provided in such a manner that regions not adjacent to the hole group are formed substantially as square regions while regions adjacent to the hole group are formed substantially as rectangular regions each obtained by dividing one square region into two. Because the average area of the regions adjacent to the hole group is smaller than the average area of the regions not adjacent to the hole group, choking of ink flow paths constituted by the apertures 12 and the connection holes 12*d* can be restrained from being caused by inflow, into the inside of the hole group, of the adhesive agent which is part of the adhesive agent applied on the bonding tabs on the base plate 23 side of the aperture plate 24 to bond the base plate 23 to the aperture plate 24 and which is applied on the outside of the hole group. As a result, choking of each ink flow path can be suppressed more sufficiently.

Because the region of application of the adhesive agent in the region except the hole group region and the opening 3*b* is separated into a plurality of partitions by the connection grooves 63, the region of application of the adhesive agent and the region free from application of the adhesive agent can be prevented from becoming excessive. That is, if an air reservoir is present between the aperture plate and the base plate when the aperture plate having no connection groove 63 is bonded to the base plate by application of the adhesive agent on the adhesive agent application region of the aperture plate, the air reservoir region is spread between the aperture plate and the base plate to enlarge the bonding failure region (non-application region) to thereby make adhesion between the aperture plate and the base plate unstable when the base plate and the aperture plate are pressure-bonded to each other. However, when the connection grooves 63 are formed as represented by the aperture plate 24, the air can be escaped from the connection grooves 63 even in the case where the two plates 23 and 24 are pressure-bonded to each other in the condition that the air reservoir is present between the aperture plate and the base plate 23. As a result, the boding failure region can be prevented from being enlarged. Moreover, a surplus of the adhesive agent can be received in the connection grooves 63. Accordingly, the adhesive agent can be prevented from being spread to the other region than the adhesive agent application region in the partition. Accordingly, stability in adhesion between the base plate 23 and the aperture plate 24 can be improved.

Moreover, when the base plate 23 and the aperture plate 24 are bonded and laminated on each other to produce the flow path unit 4, holes for connecting part of the connection grooves 63 to the outside are provided in advance so that the air is sucked through the holes to make the internal pressure of the connection grooves 63 negative. As a result, a negative pressure can be easily applied to the encircling grooves 61 and the inner grooves 65 connected to the connection grooves 63 while a surplus of the adhesive agent can be attracted into the connection grooves 63. Accordingly, a surplus of the adhesive agent in neighbors of the encircling grooves 61 and the inner grooves 65 can be attracted into both the grooves 61 and 65. Accordingly, the adhesive agent hardly flows into the apertures 12 and the connection holes 12*d*, so that choking of each individual ink flow path 32 can be suppressed.

Figure 10A:
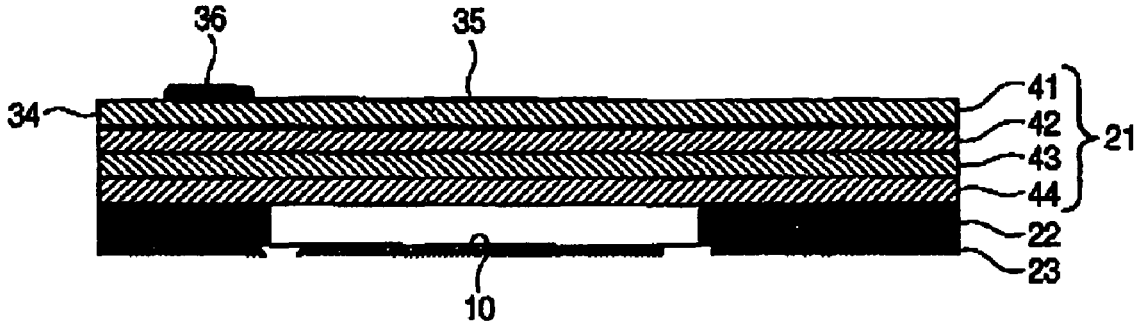
FIG. 10A is a partially enlarged sectional view showing an actuator unit and a pressure chamber.
Figure 10B:
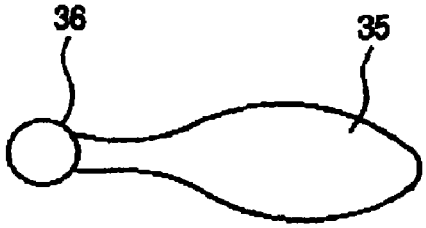
FIG. 10B is a plan view showing the shape of an individual electrode bonded to a surface of the actuator unit.

Next, the configuration of the actuator unit 21 laminated on the cavity plate 22 as the uppermost layer of the flow path unit 4 will be described. FIG. 10A is a partially enlarged sectional view showing the actuator unit 21 and a pressure chamber 10. FIG. 10B is a plan view showing the shape of an individual electrode bonded to a surface of the actuator unit 21.

As shown in FIG. 10A, the actuator unit 21 includes four piezoelectric sheets 41, 42, 43 and 44 formed to have a thickness of about 15 μm equally. The piezoelectric sheets 41 to 44 are provided as stratified flat plates (continuous flat plate layers) which are continued to one another so as to be arranged over a large number of pressure chambers 10 formed in one ink ejection region in the head body 70. Because the piezoelectric sheets 41 to 44 are arranged as continuous flat plate layers over the large number of pressure chambers 10, the individual electrodes 35 can be disposed densely on the piezoelectric sheet 41 when, for example, a screen printing technique is used. Accordingly, the pressure chambers 10 formed in positions corresponding to the individual electrodes 35 can be also disposed densely, so that a high-resolution image can be printed. Each of the piezoelectric sheets 41 to 44 is made of a ceramic material of the lead zirconate titanate (PZT) type having ferroelectricity.

The individual electrodes 35 are formed on the piezoelectric sheet 41 as the uppermost layer. A common electrode 34 having a thickness of about 2 μm is interposed between the piezoelectric sheet 41 as the uppermost layer and the piezoelectric sheet 42 located under the piezoelectric sheet 41 so that the common electrode 34 is formed on the whole surface of the piezoelectric sheet 42. Incidentally, no electrode is disposed between the piezoelectric sheet 42 and the piezoelectric sheet 43 and between the piezoelectric sheet 43 and the piezoelectric sheet 44. The individual electrodes 35 and the common electrode 34 are made of a metal material such as Ag—Pd.

As shown in FIG. 10B, each individual electrode 35 has a thickness of about 1 μm and substantially has a rhomboid shape nearly similar to the shape of the pressure camber 10 shown in FIG. 5. An acute-angled portion of each approximately rhomboid individual electrode 35 extends. A circular land portion 36 having a diameter of about 160 μm is provided at an end of the extension of the acute-angled portion of the individual electrode 35 so as to be electrically connected to the individual electrode 35. For example, the land portion 36 is made of gold containing glass frit. As shown in FIG. 10A, the land portion 36 is bonded onto a surface of the extension of the individual electrode 35.

The common electrode 34 is grounded to a region not shown. Accordingly, the common electrode 34 is kept at ground potential equally in regions corresponding to all the pressure chambers 10. The individual electrodes 35 are connected to the driver IC 80 through the FPC 50 including independent lead wires in accordance with the individual electrodes 35 so that electric potential can be controlled in accordance with each pressure chamber 10 (see FIGS. 1 and 2).

Next, a drive method of the actuator unit 21 will be described. The direction of polarization of the piezoelectric sheet 41 in the actuator unit 21 is a direction of the thickness of the piezoelectric sheet 41. That is, the actuator unit 21 has a so-called unimorph type structure in which one piezoelectric sheet 41 on an upper side (i.e., far from the pressure chambers 10) is used as a layer including an active layer while three piezoelectric sheets 42 to 44 on a lower side (i.e., near to the pressure chambers 10) are used as non-active layers. Accordingly, when the electric potential of an individual electrode 35 is set at a predetermined positive or negative value, an electric field applied portion of the piezoelectric sheet 41 put between electrodes serves as an active layer (pressure generation portion) and shrinks in a direction perpendicular to the direction of polarization by the transverse piezoelectric effect, for example, if the direction of the electric field is the same as the direction of polarization. On the other hand, the piezoelectric sheets 42 to 44 are not affected by the electric field, so that the piezoelectric sheets 42 to 44 are not displaced spontaneously. Accordingly, a difference in distortion in a direction perpendicular to the direction of polarization is generated between the piezoelectric sheet 41 on the upper side and the piezoelectric sheets 42 to 44 on the lower side, so that the whole of the piezoelectric sheets 41 to 44 is to be deformed so as to be curved convexly on the non-active side (unimorph deformation). On this occasion, as shown in FIG. 10A, the lower surface of the whole of the piezoelectric sheets 41 to 44 is fixed to the upper surface of the partition wall (cavity plate) 22 which partitions the pressure chambers. As a result, the piezoelectric sheets 41 to 44 are deformed so as to be curved convexly on the pressure chamber side. For this reason, the volume of the pressure chamber 10 is reduced to increase the pressure of ink to thereby eject ink from a nozzle 8 connected to the pressure chamber 10. Then, when the electric potential of the individual electrode 35 is returned to the same value as the electric potential of the common electrode 34, the piezoelectric sheets 41 to 44 are restored to the original shape so that the volume of the pressure chamber 10 is returned to the original value. As a result, ink is sucked from the manifold 5 side.

Incidentally, another drive method may be used as follows. The electric potential of each individual electrode 35 is set at a value different from the electric potential of the common electrode 34 in advance. Whenever there is an ejection request, the electric potential of the individual electrode 35 is once changed to the same value as the electric potential of the common electrode 34. Then, the electric potential of the individual electrode 35 is returned to the original value different from the electric potential of the common electrode 34 at predetermined timing. In this case, the piezoelectric sheets 41 to 44 are restored to the original shape at the timing when the electric potential of the individual electrode 35 becomes equal to the electric potential of the common electrode 34. Accordingly, the volume of the pressure chamber 10 is increased compared with the initial state (in which the two electrodes are different in electric potential from each other), so that ink is sucked from the manifold 5 side into the pressure chamber 10. Then, the piezoelectric sheets 41 to 44 are deformed so as to be curved convexly on the pressure chamber 10 side at the timing when the electric potential of the individual electrode 35 is set at the original value different from the electric potential of the common electrode 34 again. As a result, the volume of the pressure chamber 10 is reduced to increase the pressure of ink to thereby eject ink.

Referring back to FIG. 5, a zonal region R having a width (678.0 μm) corresponding to 37.5 dpi in the arrangement direction A and extending in the arrangement direction B will be considered. Only one nozzle 8 is present in any one of sixteen pressure chamber columns 11*a* to 11*d* in the zonal region R. That is, when such a zonal region R is formed in an optional position of the ink ejection region corresponding to one actuator unit 21, sixteen nozzles 8 are always distributed in the zonal region R. The positions of points obtained by projecting the sixteen nozzles 8 onto a line extending in the arrangement direction A are arranged at intervals of a distance corresponding to 600 dpi which is resolution at the time of printing.

When the sixteen nozzles 8 belonging to one zonal region R are numbered as (1) to (16) in rightward order of the positions of points obtained by projecting the sixteen nozzles 8 onto a line extending in the arrangement direction A, the sixteen nozzles 8 are arranged in ascending order of (1), (9), (5), (13), (2), (10), (6), (14), (3), (11), (7), (15), (4), (12), (8) and (16). When the inkjet printing head 1 configured as described above is driven suitably in accordance with conveyance of a printing medium in the actuator unit 21, characters, graphics, etc. having resolution of 600 dpi can be drawn.

For example, description will be made on the case where a line extending in the arrangement direction A is printed with resolution of 600 dpi. First, brief description will be made on the case of a reference example in which each nozzle 8 is connected to the acute-angled portion on the same side of the pressure chamber 10. In this case, a nozzle 8 in the pressure chamber column located in the lowermost position in FIG. 5 begins to eject ink in accordance with conveyance of the printing medium. Nozzles 8 belonging to adjacent pressure chamber columns on the upper side are selected successively to eject ink. Accordingly, dots of ink are formed so as to be adjacent to one another at intervals of a distance corresponding to 600 dpi in the arrangement direction A. Finally, a line extending in the arrangement direction A is drawn with resolution of 600 dpi as a whole.

On the other hand, in this embodiment, a nozzle 8 in the pressure chamber column 11*b* located in the lowermost position in FIG. 5 begins to eject ink. As the printing medium is conveyed, nozzles 8 connected to adjacent pressure chambers on the upper side are selected successively to eject ink. On this occasion, the displacement of the nozzle 8 position in the arrangement direction A in accordance with increase in position by one pressure chamber column from the lower side to the upper side is not constant. Accordingly, dots of ink formed successively along the arrangement direction A in accordance with conveyance of the printing medium are not arranged at regular intervals of 600 dpi.

That is, as shown in FIG. 5, ink is first ejected from the nozzle (1) connected to the pressure chamber column 11*b* located in the lowermost position in FIG. 5 in accordance with conveyance of the printing medium. A row of dots are formed on the printing medium at intervals of a distance corresponding to 37.5 dpi. Then, when the line forming position reaches the position of the nozzle (9) connected to the second lowest pressure chamber column 11*a* as the printing medium is conveyed, ink is ejected from the nozzle (9). As a result, a second ink dot is formed in a position displaced by eight times as large as the distance corresponding to 600 dpi in the arrangement direction A from the initial dot position.

Then, when the line forming position reaches the position of the nozzle (5) connected to the third lowest pressure chamber column 11*d* as the printing medium is conveyed, ink is ejected from the nozzle (5). As a result, a third ink dot is formed in a position displaced by four times as large as the distance corresponding to 600 dpi in the arrangement direction A from the initial dot position. When the line forming position reaches the position of the nozzle (13) connected to the fourth lowest pressure chamber column 11*c* as the printing medium is further conveyed, ink is ejected from the nozzle (13). As a result, a fourth ink dot is formed in a position displaced by twelve times as large as the distance corresponding to 600 dpi in the arrangement direction A from the initial dot position. When the line forming position reaches the position of the nozzle (2) connected to the fifth lowest pressure chamber column 11*b* as the printing medium is further conveyed, ink is ejected from the nozzle (2). As a result, a fifth ink dot is formed in a position displaced by the distance corresponding to 600 dpi in the arrangement direction A from the initial dot position.

Then, ink dots are formed in the same manner as described above while nozzles 8 connected to the pressure chambers 10 are selected successively from the lower side to the upper side in FIG. 5. When N is the number of a nozzle 8 shown in FIG. 5 on this occasion, an ink dot is formed in a position displaced by a value corresponding to (the ratio n=N−1)×(the distance corresponding to 600 dpi) in the arrangement direction A from the initial dot position. Finally, when selection of the sixteen nozzles 8 is completed, fifteen dots formed at intervals of a distance corresponding to 600 dpi are interpolated in between ink dots formed at intervals of a distance corresponding to 37.5 dpi by the nozzle (1) in the lowest pressure chamber column 11*b* in FIG. 5. As a result, a line extending in the arrangement direction A can be drawn with resolution of 600 dpi as a whole.

Incidentally, printing with resolution of 600 dpi can be achieved when neighbors of opposite end portions of each ink ejection region (inclined sides of each actuator unit 21) in the arrangement direction A are complementary to neighbors of opposite end portions of corresponding ink ejection regions in the arrangement direction A to other actuator unit 21 opposed to the actuator unit 21 in the direction of the width of the head body 70.

In the aperture plate 24 of the flow path unit 4 in the inkjet printing head 1 according to this embodiment as described above, the encircling grooves 61 are formed as the outer circumferences of the hole groups each constituted by the plurality of apertures 12 and the connection holes 12*d*. Accordingly, even in the case where irregularity or variation in application of the adhesive agent occurs in the adhesive agent applied on the aperture plate 24 because the size of the head body 70 is increased by dense arrangement of the ink ejection nozzles 8 when the base plate 23 and the aperture plate 24 are bonded to each other, the adhesive agent can be restrained from flowing from the outside of the hole groups into the apertures 12 and the connection holes 12*d* in the hole groups. That is, a surplus of the adhesive agent moving from the outside of the hole groups to the inside of the hole groups can be received in the encircling grooves 61, so that the adhesive agent can be restrained from flowing into the apertures 12 and the connection holes 12*d* in the hole groups. Accordingly, choking of each individual ink flow path 32 in the flow path unit 4 can be prevented from being caused by inflow of the adhesive agent.

In the inkjet printing head 1 having the flow path unit 4 with the laminated bonding structure as described above, choking of each individual ink flow path 32 due to the adhesive agent hardly occurs when the head body 70 is produced. Accordingly, the quality of production of the head body 70 is improved. Moreover, the number of defective products of the inkjet printing head is reduced so that the yield is improved. Moreover, because the encircling grooves are formed in the aperture plate 24, the adhesive agent hardly flows into the apertures 12 having slender connection portions 12*c*. Accordingly, the yield of the inkjet printing head 1 is improved as described above.

Although preferred embodiments of the invention have been described above, the invention is not limited to the embodiments. Various changes on design may be made without departing from the scope of claim. For example, the inner grooves 65, the connection grooves 63 and 64 and the opening encircling grooves 62 may not be formed in the aperture plate 24 of the inkjet printing head 1 according to any one of the embodiments.

Grooves like the encircling grooves may be provided in the outer circumferences of portions (such as pressure chambers, through-holes, etc.) constituting the individual ink flow paths 32 formed in the plurality of sheet members (thin plate members) constituting the flow path unit 4 in the inkjet printing head 1 according to any one of the embodiments. Grooves like the connection grooves 63 may be provided in the sheet members respectively.

The laminated bonding structure of the thin plate members in the invention can be generally applied to a laminated bonding structure in which a plurality of thin plate members including at least one thin plate member having encircling grooves for encircling the outer circumferences of hole groups each constituted by a plurality of holes are laminated through an adhesive agent.

As described above, according to the embodiment, choking of a flow path due to inflow of an adhesive agent from the outside of the hole group can be suppressed even in the case where the size of a laminated bonding structure such as an inkjet printing head becomes large.

The laminated bonding structure of thin plate members according to the embodiment includes a plurality of thin plate members laminated through an adhesive agent, the plurality of thin plate members including at least one thin plate member having a plurality of holes formed therein, wherein hole group encircling grooves for encircling hole groups each constituted by a plurality of holes are formed in the thin plate member having the plurality of holes.

According to the above configuration, choking of each flow path caused by inflow of the adhesive agent from the outside of each hole group hardly occurs even in the case where the size of the laminated bonding structure in the inkjet printing head or the like increases.

In the embodiment, it is preferable that each of the hole group encircling grooves has a shape along the shape of the holes located in the outermost circumference of a corresponding hole group. According to this configuration, choking of each flow path can be suppressed while the area of application of the adhesive agent is retained.

In the embodiment, it is preferable that an inner groove for encircling one hole or a plurality of holes is formed through a bonding tab in each hole group in the thin plate member having the plurality of holes. According to this configuration, choking of each flow path caused by inflow of the adhesive agent can be suppressed more sufficiently.

In this case, the inner groove may have a shape along the shape of the hole(s). According to this configuration, choking of each flow path can be suppressed while the area of application of the adhesive agent is retained.

In this case, a plurality of inner grooves as defined above may be connected to one another in each hole group. According to this configuration, choking of each flow path caused by inflow of the adhesive agent can be suppressed more sufficiently.

In this case, the hole group encircling grooves and the inner grooves may be connected to one another. According to this configuration, choking of each flow path caused by inflow of the adhesive agent can be suppressed more sufficiently.

In the invention, it is preferable that a surface of the thin plate member having the plurality of holes is divided into a plurality of partitions by partition grooves on the outside of each hole group, and that the partition grooves and the hole group encircling grooves are connected to one another. According to this configuration, choking of each flow path caused by inflow of the adhesive agent can be suppressed more sufficiently. Moreover, bonding stability can be improved because the region of application of the adhesive agent and the region free from application of the adhesive agent can be prevented from becoming excessive. In addition, a negative pressure for preventing inflow of the adhesive agent can be easily applied to the inner grooves at the time of production.

In another aspect, the laminated bonding structure of thin plate members according to the embodiment has a plurality of thin plate members laminated through an adhesive agent, the plurality of thin plate members including at least one thin plate member having a plurality of holes formed therein, wherein a surface of the thin plate member having the plurality of holes is divided into a plurality of partitions by partition grooves on the outside of each hole group in which the plurality of holes are arranged.

According to the above configuration, bonding stability can be improved because the region of application of the adhesive agent and the region free from application of the adhesive agent can be prevented from becoming excessive. In addition, choking of each flow path caused by inflow of the adhesive agent can be suppressed.

In the embodiment, it is preferable that the average area of the partitions adjacent to each hole group is not larger than the average area of the outside of the partitions. According to this configuration, choking of each flow path caused by inflow of the adhesive agent can be suppressed more sufficiently.

In the embodiment, it is preferable that the partition grooves are formed in a lattice-like arrangement. According to this configuration, choking of each flow path caused by inflow of the adhesive agent can be suppressed more sufficiently.

In another aspect, the embodiment provides an inkjet printing head including a laminated bonding structure of thin plate members defined above, wherein outlets of the flow paths are nozzles for ejecting ink. According to this configuration, the yield of the head is improved.

In this case, it is preferable that at least one of the thin plate members is a member for adjusting flow path resistance of ink in the flow paths. According to this configuration, because holes formed in the member for adjusting flow path resistance of ink in the flow paths are narrow, the yield of the head is improved more greatly when ink choking in the holes is prevented.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An inkjet printing head comprising:

a flow path unit including:

a manifold as a common ink chamber;

a plurality of individual ink flow paths, each individual ink flow path extending from the manifold and including a pressure chamber connected to a nozzle;

an opening communicating with the manifold and being opened to outside the flow path unit;

a plurality of thin plate members laminated through an adhesive agent, the plurality of thin plate members including at least one thin plate member having a plurality of first holes and a second hole formed therein, each first hole being a part of an individual ink flow path, and the second hole being a part of the opening or a part of the manifold;

a hole group encircling groove that encircles a hole group including at least part of the plurality of first holes, wherein the hole group encircling groove includes:

curved portions formed along a shape of all the first holes located in an outermost circumference of a corresponding hole group, and the second hole being located outside a region encircled by the hole group encircling groove; and an inner groove that encircles at least one first hole of the hole group formed on the thin plate member, the inner groove being formed in the region encircled by the hole group encircling groove and including a curved portion formed along a shape of the first hole that is encircled by the inner groove.

2. The inkjet printing head according to claim 1, wherein a plurality of the inner grooves are formed.

3. The inkjet printing head according to claim 2, wherein the inner grooves are connected to one another in the region encircled by the hole group encircling groove.

4. The inkjet printing head according to claim 3, wherein the hole group encircling groove and the inner grooves are connected to one another.

5. The inkjet printing head according to claim 1, wherein the hole group encircling groove and the inner groove are connected to one another.

6. The inkjet printing head according to claim 1 further comprising a partition groove formed on the thin plate member having the plurality of first holes and a second hole, the partition groove formed outside of the hole group and divides a surface of the thin plate member into a plurality of partitions.

7. The inkjet printing head according to claim 6, wherein the partition groove and the hole group encircling groove are connected to one another.

8. The inkjet printing head according to claim 6, wherein an average area of the partitions adjacent to the hole group is configured to be not larger than an average area of the partitions not adjacent to the hole group.

9. The inkjet printing head according to claim 6, wherein the partition groove is formed in a lattice-like arrangement.

10. An inkjet printing head comprising:

an actuator unit being fixed to a surface of a flow path unit including pressure chambers arranged along a plane and connected to nozzles, respectively, and the actuator unit changes a volume of each of the pressure chambers, wherein the flow path unit includes:

a manifold as a common ink chamber;

a plurality of individual ink flow paths, each individual ink flow path extending from the manifold and including a pressure chamber connected to a nozzle;

an opening communicating with the manifold and being opened outside the flow path unit;

a plurality of thin plate members laminated through an adhesive agent, the plurality of thin plate members including at least one thin plate member having a plurality of first holes and a second hole formed therein, each first hole being a part of an individual ink flow path, and the second hole being a part of the opening or a part of the manifold;

a hole group encircling groove that encircles a hole group including at least part of the plurality of first holes, wherein the hole group encircling groove includes:

curved portions formed along a shape of all the first holes located in an outermost circumference of a corresponding hole group, and the second hole being located outside a region encircled by the hole group encircling groove; and an inner groove that encircles at least one first hole of the hole group formed on the thin plate member, the inner groove being formed in the region encircled by the hole group encircling groove and including a curved portion formed along a shape of the first holes that is encircled by the inner groove.

11. The inkjet printing head according to claim 10, wherein a plurality of the inner grooves are formed.

12. The inkjet printing head according to claim 11, wherein the inner grooves are connected to one another in the region encircled by the hole group encircling groove.

13. The inkjet printing head according to claim 10, wherein the hole group encircling groove and the inner groove are connected to one another.

14. The inkjet printing head according to claim 12, wherein the hole group encircling groove and the inner grooves are connected to one another.

15. The inkjet printing head according to claim 10 further comprising a partition groove formed on the thin plate member having the plurality of holes, the partition groove formed on outside of the hole group and divides a surface of the thin plate member into a plurality of partitions.

16. The inkjet printing head according to claim 15, wherein the partition groove and the hole group encircling groove are connected to one another.

17. The inkjet printing head according to claim 15, wherein an average area of the partitions adjacent to the hole group is configured to be not larger than an average area of the partitions not adjacent to the hole group.

18. The inkjet printing head according to claim 15, wherein the partition groove is formed in a lattice-like arrangement.

* * * * *